US005690333A

United States Patent [19]

Danner et al.

[11] Patent Number: 5,690,333

[45] Date of Patent: Nov. 25, 1997

[54] BOARD GAME APPARATUS AND METHOD OF PLAYING SAME

[76] Inventors: David A. Danner, 1544 Blaine Ave., Racine, Wis. 53405; Jamie S. Verzal, 32401 Bassett Rd., Burlington, Wis. 53105; Robert S. Zwickey, 10818 Washington Ave., Sturtevant, Wis. 53177

[21] Appl. No.: 688,390

[22] Filed: Jul. 30, 1996

[51] Int. Cl.[6] ..... A63F 3/02

[52] U.S. Cl. ..... 273/260; 273/242

[58] Field of Search ..... 273/260, 261, 273/248, 249, 288, 242

[56] References Cited

U.S. PATENT DOCUMENTS

| | | | |
|---|---|---|---|
| 145,706 | 12/1873 | Wilhelm . | |
| 1,030,330 | 6/1912 | Rogers . | |
| 3,191,184 | 6/1965 | Durstewitz | 273/249 |
| 3,997,165 | 12/1976 | Barsky . | |
| 4,961,583 | 10/1990 | Koch et al. | 273/260 |
| 4,988,110 | 1/1991 | Zuckerman | 273/288 X |
| 5,542,678 | 8/1996 | Woodbridge | 273/260 |

FOREIGN PATENT DOCUMENTS

| | | | |
|---|---|---|---|
| 2632356 | 1/1978 | Germany | 273/288 |

*Primary Examiner*—William E. Stoll
*Attorney, Agent, or Firm*—William R. Walbrun

[57] ABSTRACT

A board game apparatus and method of playing are disclosed. A game board has aligned vertical and horizontal rows of octagonal shaped playing spaces. A plurality of playing pieces are provided for placement in a predetermined starting configuration on playing spaces of the game board. After determining the order of play, the playing pieces are moved about the game board to unoccupied playing spaces in an effort to jump and thereby capture the playing piece of an opponent. Each playing piece is preferably formed of a shotglass containing a beverage therewithin. The capturing of the playing piece by one player requires the consumption of the beverage by an opposing player.

15 Claims, 4 Drawing Sheets

BOARD GAME APPARATUS AND METHOD OF PLAYING SAME

BACKGROUND OF THE INVENTION

1. Field of the Invention

The present invention relates generally to board games. More particularly, the invention pertains to a board game that can be played in a standard manner for recreation and entertainment purposes, as well as being adapted for play as a social drinking game.

2. Description of the Prior Art

Various prior art games are known in the art which require the use of a checkered game board having a plurality of playing pieces for use by opposing players, such as the popular games of checkers and chess.

Further board game variations have also been proposed, such U.S. Pat. No. 1,030,330 issued to Rogers, which includes playing pieces having a greater number and a greater variety of moves than the playing pieces in the game of checkers, but a smaller number and variety of moves than the playing pieces in the game of chess, thus meeting the needs of those who find checkers too simple and chess too complicated.

While board games such as these have been produced to stimulate the mind and require strategic thought and logic of the players, they fail to accommodate the interest of the general public during social activities or gatherings. Other games have been produced which provide for pure entertainment, emphasizing some aspect of our culture or society, such as social drinking. However, no such game combines strategic game playing with an emphasis on social drinking during the coarse of play, as is now provided in the present invention.

As will be described in greater detail hereinafter, the method and game apparatus of the present invention differs from those previously proposed and employs a number of novel features that render it highly advantageous over the prior art.

SUMMARY OF THE INVENTION

Accordingly, it is an object of this invention to provide a strategic board game that can be played by the general public by players of all ages, as well as being played as a social drinking game.

Another object of this invention is to provide a board game that is easy to learn and play.

Still another object of this invention is to provide a board game that when played as social drinking game incorporates the drinking of an alcoholic or non-alcoholic beverage within the manner of play.

Yet another object of this invention is to provide a board game that can be played in under thirty minutes and can be inexpensively manufactured.

To achieve the foregoing and other objectives, and in accordance with the purposes of the present invention a method of playing a board game is provided. The method includes the steps of providing a game board having peripheral borders defined by a first player end, a second player end, and two sides, the game board having aligned vertical and horizontal rows of playing spaces; providing a plurality of playing pieces, the playing pieces being divided into first and second sets of playing pieces; placing the playing pieces in a predetermined starting configuration on playing spaces of the game board; determining the order of play; and moving the playing pieces about the game board to unoccupied playing spaces in an effort to jump and thereby capture the playing piece of an opponent.

In accordance with an aspect of the invention, each playing piece is formed of a shotglass having an open cavity adapted for containing a beverage therewithin. Further, the capturing of the playing piece by one player requires the consuming of the beverage by an opposing player which has been filled and contained within the respective playing piece.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
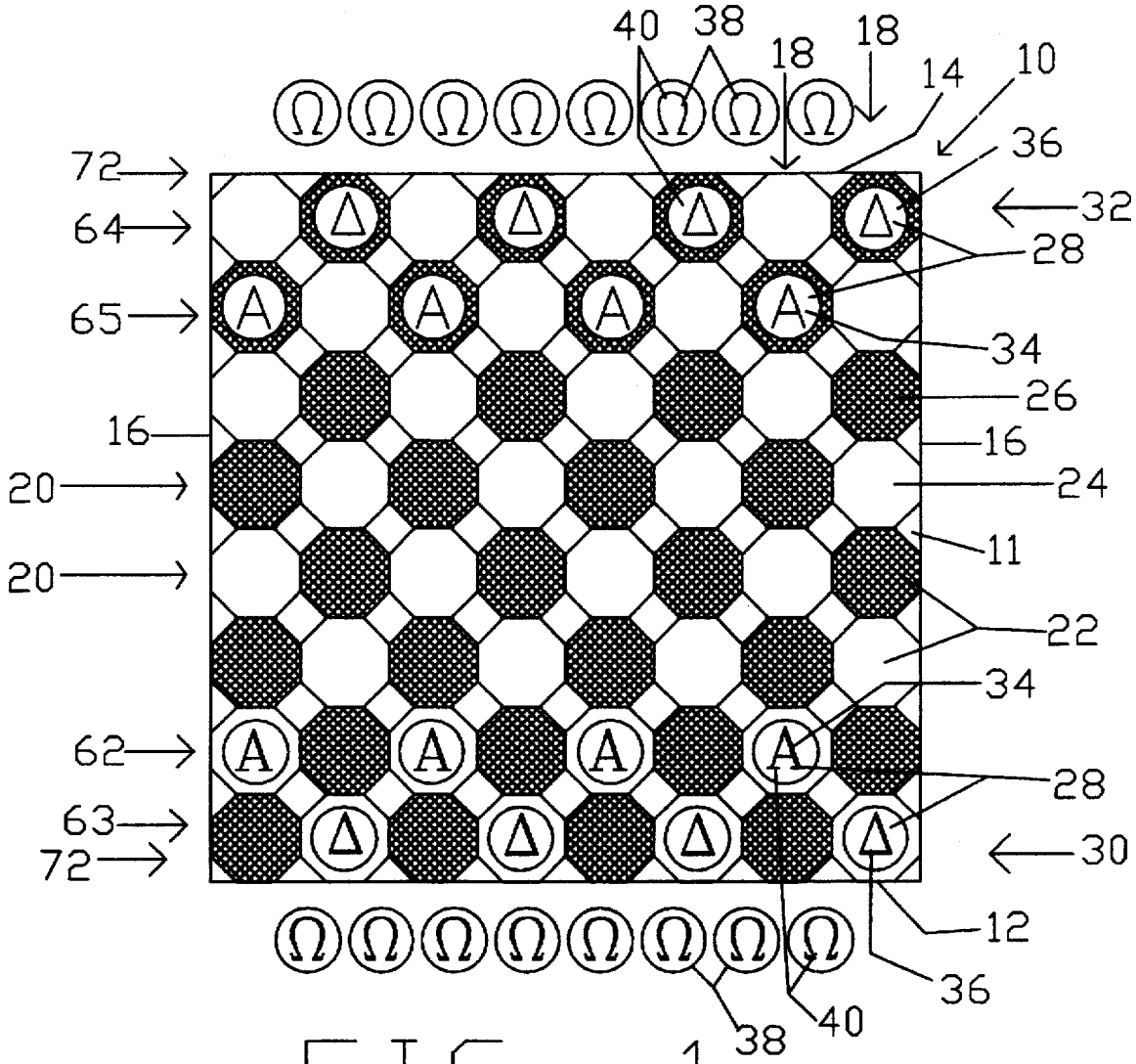
FIG. 1 is a top plan view of the game board of the present invention having playing pieces of one embodiment arranged in a game starting configuration.

Referring now to the drawings, a game board 10 is illustrated in FIG. 1. The game board 10 has peripheral borders defined by a first player end 12, a second player end 14, and two opposing sides 16. The game board 10 has aligned vertical rows 18 and horizontal rows 20 of playing spaces 22.

In the preferred embodiment shown, the game board 10 has a water resistant surface 11 and is formed of eight vertical rows 18 and eight horizontal rows 20 which produce of sixty-four playing spaces 22, which are octagonal shaped. The playing spaces 22 are colored in a checkerboard pattern with yellow playing spaces 24 being adjacent to black playing spaces 26.

A plurality of playing pieces 28 are provided. The playing pieces 28 are divided into a first set 30 of playing pieces and a second set 32 of playing pieces. The first and second sets 30, 32 are identical except that the first set 30 is colored yellow or otherwise marked with indicia or color to represent the first set 30 for use with one player. The second set 32 is colored black or otherwise marked with indicia or color to represent the second set 30 for use with an opposing player.

The first and second sets 30, 32 of playing pieces each include four first pieces or Alpha playing pieces 34, four second pieces or Delta playing pieces 36, and eight third pieces or Omega playing pieces 38. As illustrated in the FIG.

1, the playing pieces 28 can be formed of chips or pogs 40 having indicia or color coding representing the three different types of playing pieces.

It is important to note that one advantage of the present invention involves the ability and adaptability of the game to be played by people of all ages, as well as being played as social drinking game, which is not necessarily limited to alcoholic beverages. As a children's game, for example, the three type of playing pieces could be formed in the shape of animals.

Figure 2:
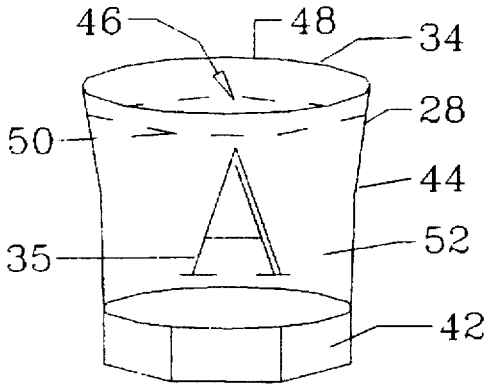
FIG. 2 is a perspective view of a preferred embodiment of a first piece or Alpha playing piece of the present invention.
Figure 3:
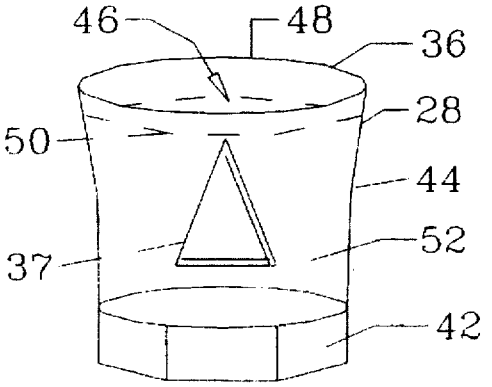
FIG. 3 is a perspective view of a preferred embodiment of a second piece or Delta playing piece of the present invention.
Figure 4:
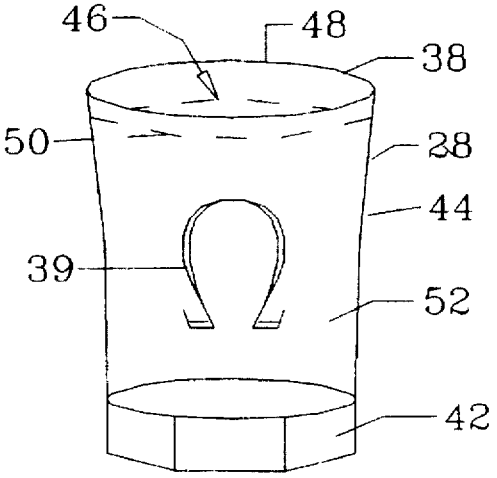
FIG. 4 is a perspective view of a preferred embodiment of a third piece or Omega playing piece of the present invention.

Referring to FIGS. 2–4, each playing piece 28 in the drinking version of the game has a bottom 42 and sidewalls 44 defining a cavity 46 having an open top portion 48. The cavity 48 is adapted for containing a beverage 50 therewithin. Each playing piece 28 is preferably formed of a shotglass. The Alpha playing piece 34 and Delta playing pieces 36 are preferably one ounce size shotglasses having the respective Alpha and Delta indicia 35, 37 provided on an outside surface 52 in a color that designates either the first set 30 or second set 32. The Omega playing pieces 38 are one and one half ounce shotglasses having the respective Omega indicia 39 provided on an outside surface 52 in a color that designates either the first set 30 or second set 32. Each opponent will be able to designate a beverage selection for use with either the first set 30 or second set 32 of playing pieces 28.

In accordance with the general rules of the game, a game is first started by placing the playing pieces 28 of each first and second set 30, 32 in a predetermined starting configuration (FIG. 1) on playing spaces 22 of the game board 10 with playing pieces 28 of the first set 30 being placed in the two horizontal rows 62, 63 adjacent the first player end 12 on playing spaces 22 corresponding to that players color. The playing pieces 28 of the second set 32 are placed in horizontal rows 64, 65 adjacent the second player end 14 on playing spaces 22 corresponding to that players color. The second pieces 36 are placed to the rear of the first pieces 34, as illustrated. It should be understood that the forward direction for each respective set 30, 32 is that direction across the game board towards the opposing player where each player is situated on a respective player end 12, 14.

Figure 5:
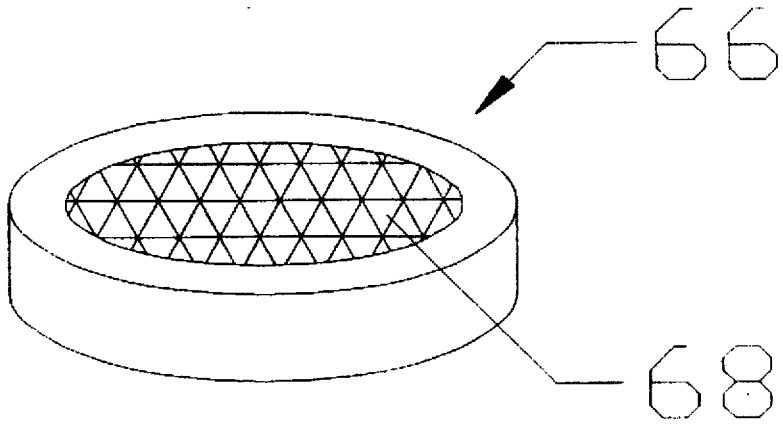
FIG. 5 is a perspective view of a first side of a Zog playing piece.
Figure 6:
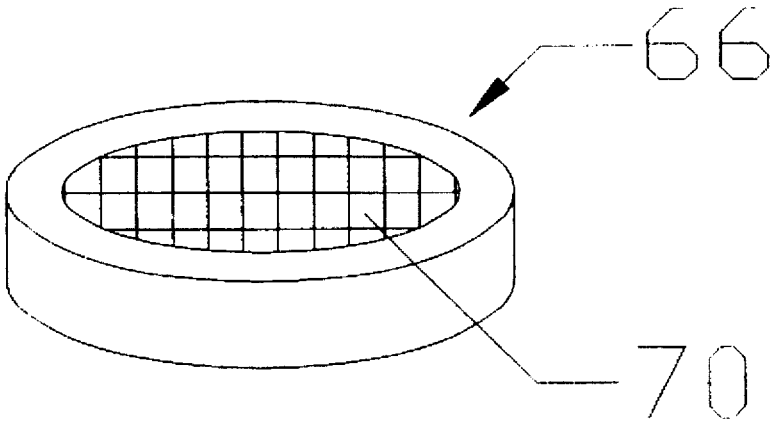
FIG. 6 is a perspective view of a second side of a Zog playing piece.

After the playing pieces 28 have been arranged in the predetermined configuration, the order of play must be determined by flipping a Zog piece or chip 66, as illustrated in FIGS. 5 and 6. The zog piece 66 has a first side 68 representing the color of one opponent and second side 70 representing the color of the other opponent. The flipping of the zog piece 66 is completed in a manner similar to a coin toss with the winner being then determined to be the first player to make a playing piece move in the game. It should be understood that other manners of choice or determination could also be employed.

Figure 7:
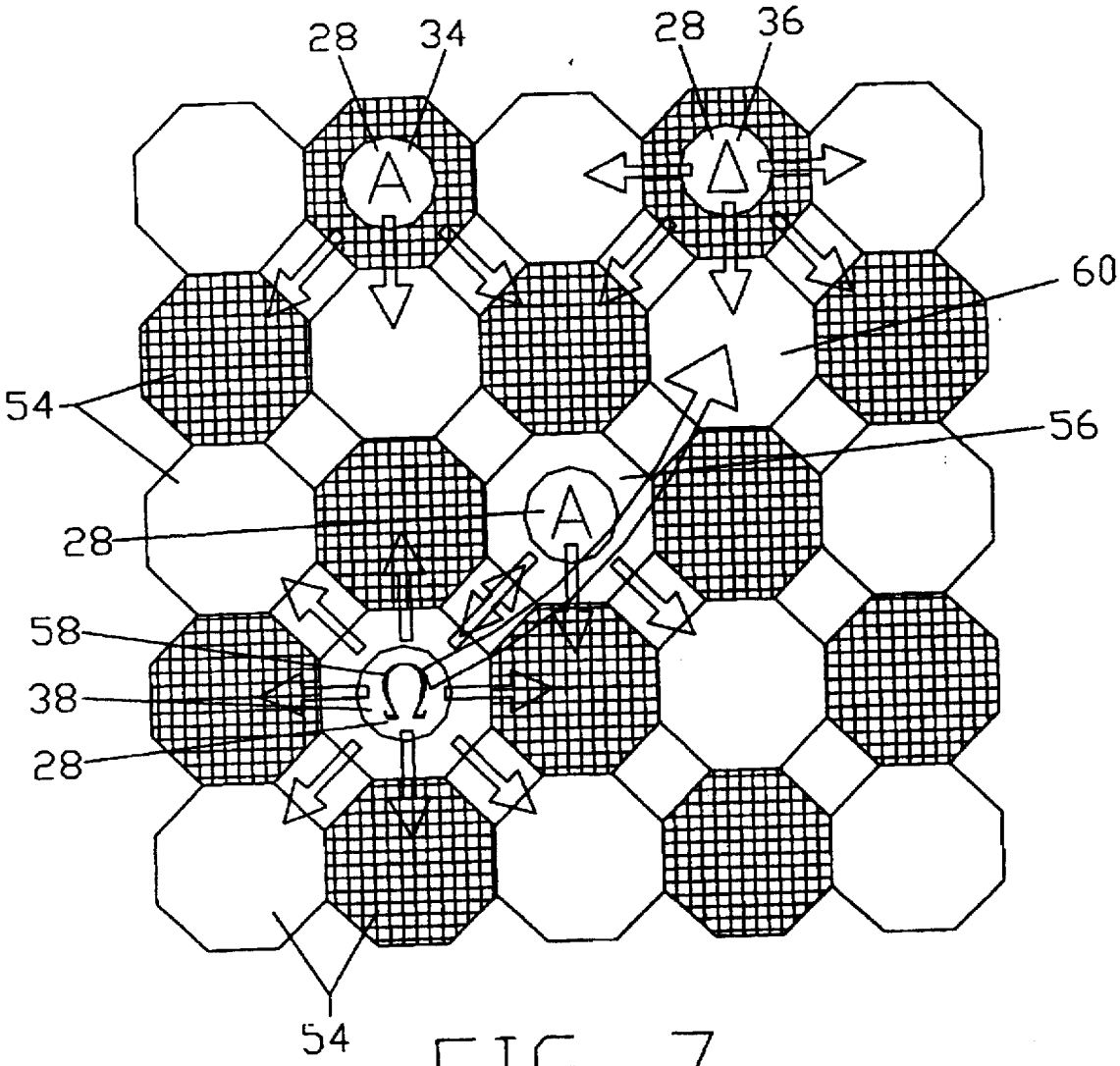
FIG. 7 is a partial top plan view of the game board illustrating possible move positions of the playing pieces.

The first pieces 34 are movable in forward and diagonally forward positions. The second pieces 36 are movable in lateral, forward and diagonally forward positions. Each move of a playing piece 28 is made to an unoccupied playing space 54 which is a distance of one playing space (FIG. 7) or if the playing space is occupied by an opponent's playing piece 56, the moving playing piece 58 may jump and capture the opponent's playing piece 56 which is a distance of two playing spaces, provided that the landing playing space 60 is unoccupied. The captured playing piece would then be removed from the game board 10. It should be noted that only one jump can be made in a single move by a playing piece. FIG. 7 illustrates the potential moves a player could make utilizing his or her first piece 34, second piece 36, or third piece 38.

The first and second pieces 34, 36 of each first and second set 30, 32 are converted or replaced with the third piece 38 from the respective first or second set 30, 32 when the first and second piece 34, 36 has moved forwardly across the game board 10 to a horizontal row 72 immediately adjacent to the corresponding player end 12, 14 of the opponent. The third piece 38 is movable in lateral, forward, backward, diagonally forward, and diagonally backward positions. Further, once converted into a third piece 38, that particular third piece 38 is allowed to make one additional bonus move at that time before the opponent is allowed to move in the next turn.

Each player continues to take turns moving his or her playing pieces 28 about the game board 10 to unoccupied playing spaces 54 and as well as capturing the playing pieces 28 of the opponent in accordance with predetermined rules previously stated. The completion of the game and a winner may be determined in several ways. The first way involves a player eliminating all of the opponents game pieces on the game board 10. A second way involves forcing an opponent to move his or her last playing piece in the same area for at least eight moves. Third way involves the setting of a time limit with the winner being declared as the player with the largest number of playing pieces 28 on the game board 10 at the completion of that time. A fourth way involves a stalemate being declared by both opponents whereby no player is deemed a winner.

In the drinking version of the game, the general rules of the game remain the same, however, the beverage filled playing pieces 28 are now used as previously described and shown in FIGS. 2–4. When a player captures an opponents playing piece, the opponent must consume of the beverage contained within the captured playing piece. When a first piece 34 or second piece 36 is converted into a third piece 38, the beverage contained in the first or second piece 34, 36 is poured into the third piece 38 with additional beverage being added if so desired. Further, at the end of the game, the losing player if so determined must drink the winners playing pieces or shotglasses which are left remaining on the game board 10.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A method of playing a board game between two opponents involving both strategy and the consumption of beverages, the method comprising the steps of;

(a) providing a game board having peripheral borders defined by a first player end, a second player end, and two sides, the game board having aligned vertical and horizontal rows of playing spaces;

(b) providing a plurality of playing pieces, the playing pieces being divided into a first set of playing pieces and a second set of playing pieces, each playing piece having a bottom and sidewalls defining a cavity having an open top potion, the cavity being adapted for containing a beverage therewithin;

(c) placing the playing pieces of each first and second set in a predetermined starting configuration on playing spaces of the game board with playing pieces of the first set being placed in horizontal rows adjacent the first player end and playing pieces of the second set being placed in rows adjacent the second player end;

(d) filling the playing pieces on the game board with a beverage;

(e) determining the order of play;

(f) moving the playing pieces about the game board to unoccupied playing spaces in accordance with predetermined rules, the playing pieces being movable to jump and thereby capture the playing piece of an opponent, the first and second sets of playing pieces each include a plurality of distinguishable first, second, and third pieces, the first pieces are movable in forward and diagonally forward positions, the second pieces are movable in lateral, forward and diagonally forward positions, the first or second pieces of each first and second set being replaceable with the third piece from the respective first or second set when the first or second piece has moved forwardly across the game board to a horizontal row immediately adjacent to the corresponding player end the third piece being movable in lateral, forward, backward, diagonally forward, and diagonally backward positions; and (g) consuming of the beverage contained within the captured playing piece by the opponent when the opponent's playing piece has been captured.

2. The method of claim 1, wherein the game board includes eight vertical and eight horizontal rows of sixty-four playing spaces.

3. The method of claim 2, wherein the playing spaces are octagonal shaped.

4. The method of claim 1, wherein the first and second sets of playing pieces each include four first pieces and four second pieces.

5. The method of claim 4, wherein the first piece is designated an Alpha, the second piece is designated a Delta, and the third piece is designated an Omega.

6. The method of claim 1, wherein each playing piece is formed of a shotglass and the step of filling the playing pieces includes the step of one opponent designating a first beverage selection for use with the first set of playing pieces and the other opponent designating a second beverage selection for use with the second set of playing pieces.

7. A method of playing a board game comprising the steps of;

(a) providing a game board having peripheral borders defined by a first player end, a second player end, and two sides, the game board having aligned vertical and horizontal rows of playing spaces;

(b) providing a plurality of playing pieces, the playing pieces being divided into a first set of playing pieces and a second set of playing pieces, the first and second sets of playing pieces each being divided into a plurality of distinguishable first, second, and third pieces;

(c) placing the first and second pieces of each first and second set in a predetermined starting configuration on playing spaces of the game board with first and second pieces of the first set being placed in horizontal rows adjacent the first player end and first and second pieces of the second set being placed in rows adjacent the second player end;

(d) determining the order of play; and (e) moving the playing pieces about the game board to unoccupied playing spaces where the first pieces are movable in forward and diagonally forward positions, the second pieces are movable in lateral, forward and diagonally forward positions, the first or second pieces of each first or second set being replaced with the third piece from the respective first or second set when the first or second piece has moved forwardly across the game board to a horizontal row immediately adjacent to the corresponding player end, the third piece being movable in lateral, forward, backward, diagonally forward, and diagonally backward positions, the playing pieces of the first and second sets being movable to jump and thereby capture the playing piece of the opposite set.

8. The method of claim 7, wherein each playing piece is formed of a shotglass having an open cavity adapted for containing a beverage therewithin.

9. The method of claim 8, wherein capturing of the playing piece by one player further includes the step of consuming of the beverage by an opposing player which has been filled and contained within the respective playing piece.

10. The method of claim 7, wherein the game board includes eight vertical rows and eight horizontal rows of sixty-four playing spaces.

11. The method of claim 10, wherein the playing spaces are octagonal shaped.

12. The method of claim 10, wherein the first and second sets of playing pieces each include four first pieces and four second pieces.

13. The method of claim 12, wherein the first piece is designated an Alpha, the second piece is designated a Delta, and the third piece is designated an Omega.

14. A method of playing a board game between two opponents involving both strategy and the consumption of beverages, the method comprising the steps of:

(a) providing a game board having peripheral borders defined by a first player end, a second player end, and two sides, the game board having aligned vertical and horizontal rows of playing spaces;

(b) providing a plurality of playing pieces, the playing pieces being divided into a first set of playing pieces and a second set of playing pieces, each playing piece having a bottom and sidewalls defining a cavity having an open top portion, the cavity being adapted for containing a beverage therewithin;

(c) placing the playing pieces of each first and second set in a predetermined starting configuration on playing spaces of the game board with playing pieces of the fast set being placed in horizontal rows adjacent the first player end and playing pieces of the second set being placed in rows adjacent the second player end;

(d) filling the playing pieces on the game board with a beverage;

(e) moving the playing pieces about the game board to unoccupied playing spaces in accordance with predetermined rules, the playing pieces being movable to jump and thereby capture the playing piece of an opponent, the first and second sets of playing pieces each include a plurality of distinguishable first, second, and third pieces, the first and second pieces of each first and second set being replaceable with the third piece from the respective first or second set when the first or second piece has moved forwardly across the game board to a horizontal row immediately adjacent to the corresponding player end, the third piece being filled with a beverage; and (g) consuming of the beverage contained within the captured playing piece by the opponent when the opponent's playing piece has been captured.

15. The method of claim 14, wherein each third piece is adapted to hold more of the beverage than each of the first and second pieces.

* * * * *